US007213353B1

(12) United States Patent
Rhoads

(10) Patent No.: US 7,213,353 B1
(45) Date of Patent: May 8, 2007

(54) FOOTWEAR CUSHIONING ATTACHMENT

(76) Inventor: Edward J. Rhoads, 3807 Hazel La., Greensboro, NC (US) 27408

( * ) Notice: Subject to any disclaimer, the term of this patent is extended or adjusted under 35 U.S.C. 154(b) by 171 days.

(21) Appl. No.: 11/085,307

(22) Filed: Mar. 21, 2005

(51) Int. Cl.
*A43B 23/00* (2006.01)

(52) U.S. Cl. ..... 36/116; 36/136

(58) Field of Classification Search ..... 36/116, 36/2.6

See application file for complete search history.

(56) References Cited

U.S. PATENT DOCUMENTS 2,430,466 A * 11/1947 Hedman ..... 36/7.5
2,565,751 A * 8/1951 Birkle ..... 604/293
3,279,102 A * 10/1966 Seeber, Sr. ..... 36/7.5
5,185,942 A * 2/1993 Decker ..... 36/11.5
5,228,217 A * 7/1993 Dabuzhsky et al. ..... 36/28
5,675,915 A 10/1997 Faughn et al.

OTHER PUBLICATIONS

Article entitled "A Water-Filled Bumper Eases Collision Impact"; New York Times, dated Dec. 25, 1966, p. 29.
Article entitled "Taxis Try Water-Filled Bumpers"; by Edward Hudson; New York Times; dated Sep. 14, 1969.

* cited by examiner

*Primary Examiner*—Ted Kavanaugh

(57) ABSTRACT

A releasable attachment is provided for parachutists' footwear to lessen the impact upon landing and to prevent injuries to the ankles, legs, knees and other body areas. The attachment consists of a fluid filled cavity and a blowout plug. The attachment is formed from a somewhat flexible polymeric material in which the cavity will collapse upon impact. The fluid contained therein will dispel and the blowout plug will release therefrom to dissipate the impact energy. The reservoir is affixed with straps to the footwear. The attachment can be quickly placed on the soles of the footwear before exiting the aircraft and easily removed after the parachutist lands. The cavities can be refilled and the blowout plugs replaced when the parachute is repacked.

15 Claims, 3 Drawing Sheets

FOOTWEAR CUSHIONING ATTACHMENT

FIELD OF THE INVENTION

The invention herein pertains to absorbing impact and particularly pertains to a footwear attachment for use by parachutists to reduce injuries during landing.

DESCRIPTION OF THE PRIOR ART AND OBJECTIVES OF THE INVENTION

The feet, ankles, legs, knees, back and other areas of the body of parachutists are sometimes injured as they often strike the ground at a high velocity. Multiple, partial and total disability claims are paid each year by the Federal Government as the result of these injures to paratroopers, burdening medical facilities, tax payers and driving up the national debt. Previous attempts have been conceived to minimize such injuries such as set forth in U.S. Pat. No. 5,675,915. Use of high density urethane foam soles as described to absorb impact is beneficial under certain circumstances, however the present invention provides a different structure and advantages over those known to be old.

Thus, the present invention was conceived and one of its objectives is to protect the lower extremities and back of a parachutist when impacting the ground upon landing.

It is another objective of the present invention to provide an attachment for the parachutists' footwear which can be readily donned or removed within seconds.

It is also an objective of the present invention to provide an attachment for footwear which can be used multiple times without decreasing in effectiveness.

It is still another objective of the present invention to provide an attachment for parachutist's footwear which includes a reservoir having a fluid filled cavity whereby the fluid is dispelled therefrom proportional to the rate of impact.

Various other objectives and advantages of the present invention will becomes apparent to those skilled in the art as a more detailed description is set forth below.

SUMMARY OF THE INVENTION

The aforesaid and other objectives are realized by providing a polymeric footwear attachment for parachutists to cushion the impact upon landing for injury elimination and reduction. The attachment includes a reservoir formed from a somewhat flexible material such as polyvinyl chloride with a fluid cavity therein. The devices are shaped similarly to the soles of the left and right parachutists' boots and may include a top ridge around the perimeter for stabilization of the attachment during wear. The reservoir includes a pair of adjustable straps which are affixed along the sides and each strap includes a top section of hook and loop fastener material. By placing the boot on the top of the attachment the straps or handles can be brought together and affixed by the hook and loop fasteners to secure the attachment on the boot. At the rear of each reservoir is a port which is in communication with the internal fluid cavity. The port is used for filling and refilling the cavity with a fluid such as water and a conically shaped blowout plug is then inserted to maintain the water therein. The fluid cavity extends substantially the entire length of the reservoir and has a depth of 0.625–1.25 cm. The blowout plug is frictionally engaged within the port so the parachutist can walk as normal without dispelling the blowout plug and fluid, such as prior to jumping from a plans.

Once the parachutist exits the plane and impacts the ground, the reservoirs flex to drive the blowout plugs and fluid from the reservoirs. The rate of fluid release from the reservoir cavity is dependent upon the force of impact and diameter of the exit apertures, thereby cushioning the lower extremities and reducing the chances of bodily injury. Once the parachutist has landed the straps on the attachments can be quickly, manually released and the attachments removed from the parachutist's boots and later refilled with fluid and replugged for reuse when the parachute is replaced.

DETAILED DESCRIPTION OF THE PREFERRED EMBODIMENT AND OPERATION OF THE INVENTION

Figure 1:
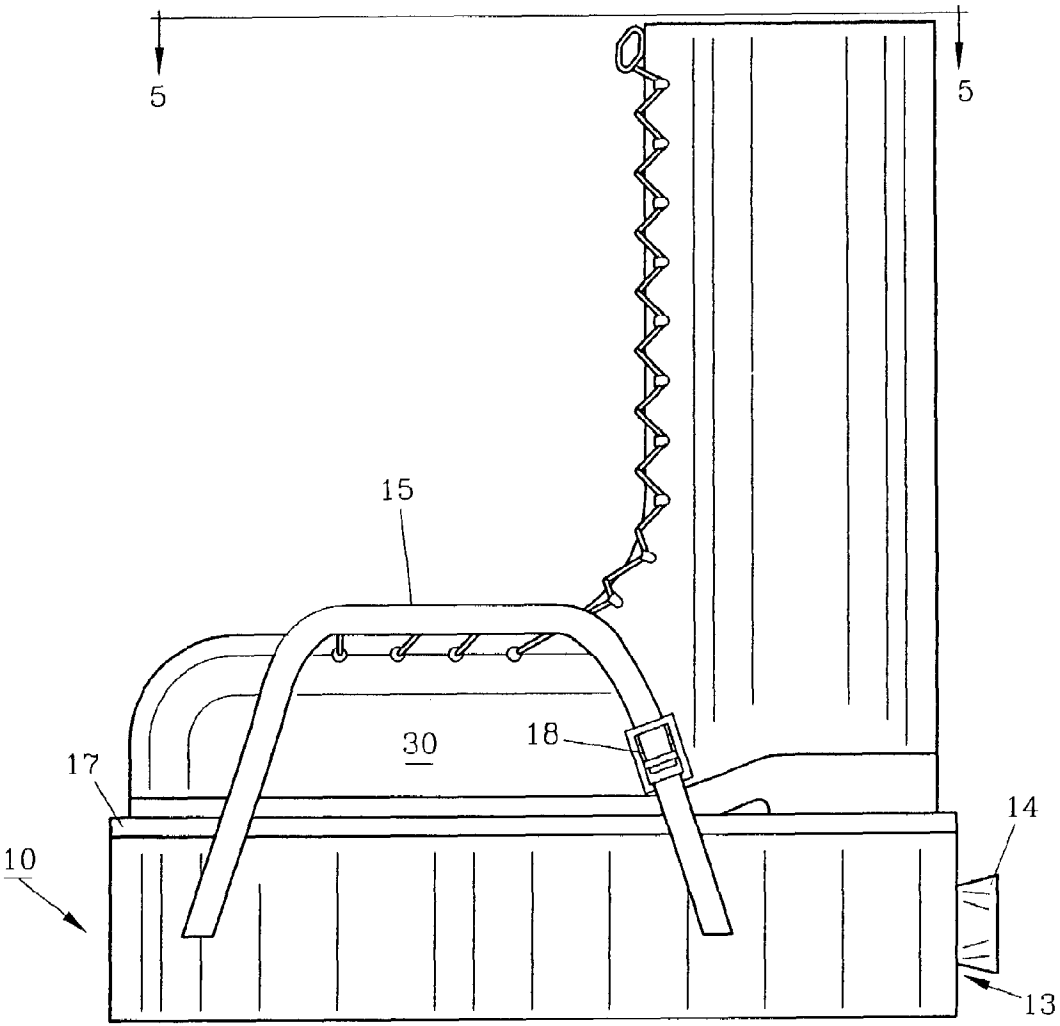
FIG. 1 shows a typical parachutist's right boot with the cushioning attachment of the invention affixed thereto.
Figure 6:
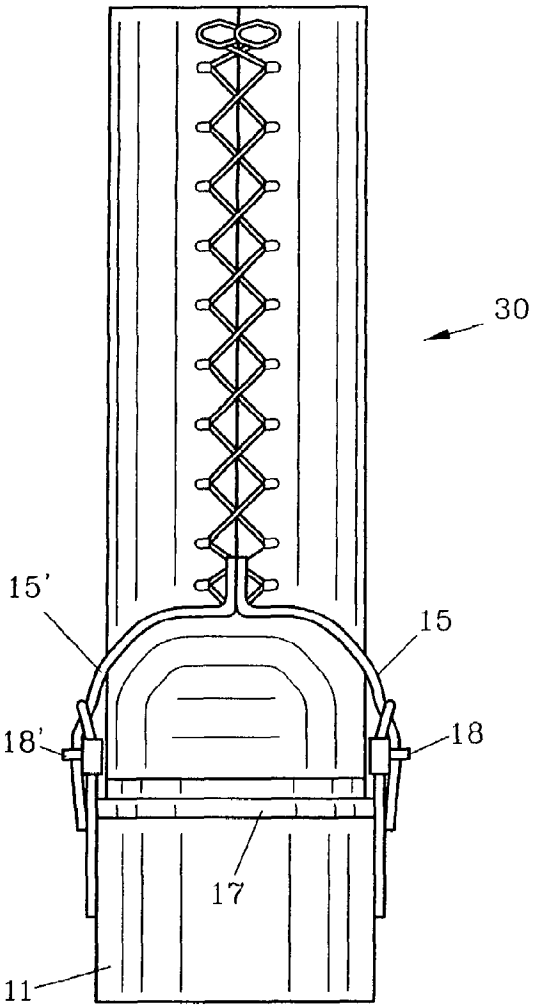
FIG. 6 demonstrates a front view of the footwear and attachment as shown in FIG. 1.
Figure 2:
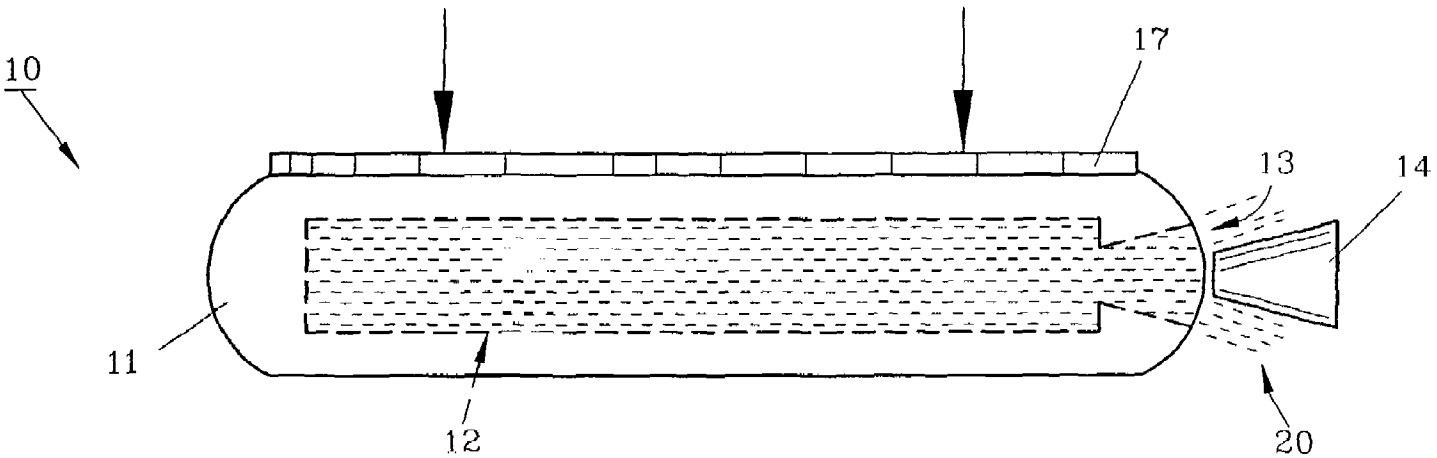
FIG. 2 demonstrates schematically the cushioning attachment without straps as removed from the footwear with the blowout plug as seen on initial impact with the ground.

For a better understanding of the invention and its operation, turning now to the drawings, FIG. 1 illustrates the preferred form of footwear cushioning attachment 10 having reservoir 11 (FIG. 2) therewithin formed from a somewhat flexible polymeric material, such as a durable polyvinyl chloride through other suitable materials may be used. Reservoir 11 preferably has an overall height of approximately 2.54 cm and includes inner fluid cavity 12 as shown in FIG. 2 which is in fluid communication with rear port 13 shown with conically shaped blowout plug 14. Multiple blowout plugs 14 may be used as desired and each blowout plug 14 could include a tether (not shown) which is attached to reservoir 11 to prevent loss. Cavity 12 preferably has a height of about 0.625–1.25 cm and extends substantially the entire length of reservoir 11. Other cavity volumes may be necessary, depending on the users and materials selected for the manufacture of reservoir 11. As would be understood, reservoir 11 would be made in various shapes and sizes to accommodate different shapes and footwear sizes for particular uses.

Figure 4:
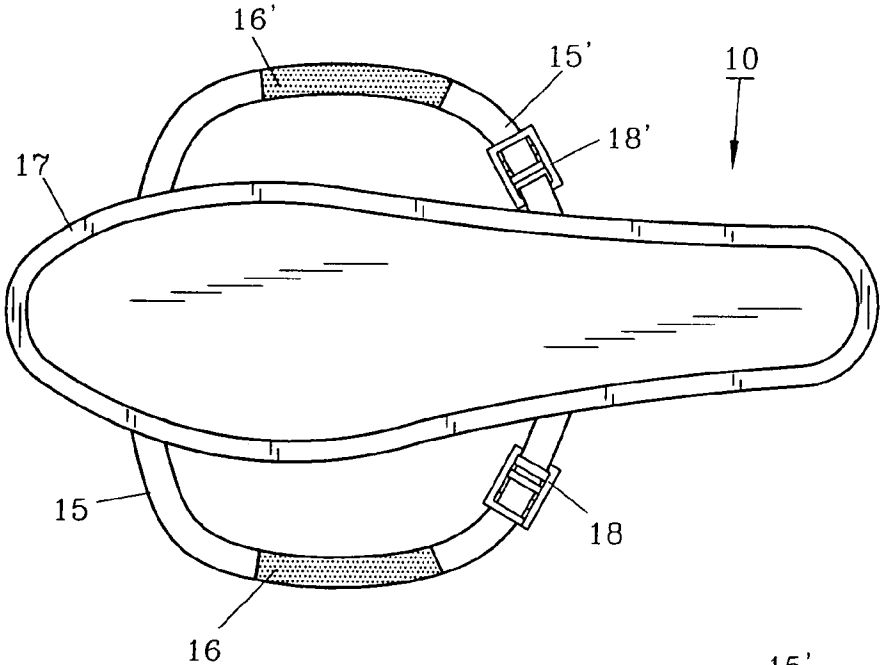
FIG. 4 depicts a top view of the attachment as seen in FIG. 1 with the footwear removed therefrom.

Adjustable straps 15, 15' are attached to the sides of reservoir 11 as by integrally forming during manufacturing or by ultrasonic welding or other conventional methods as selected by skilled manufacturing personal. Straps 15, 15' are also formed of polyvinyl chloride and can be releasably joined to each other by hook and loop fasteners 16, 16' thereon as shown in FIG. 4. Buckles 18, 18' are used to adjust the length of straps 15, 15' respectively.

Figure 3:
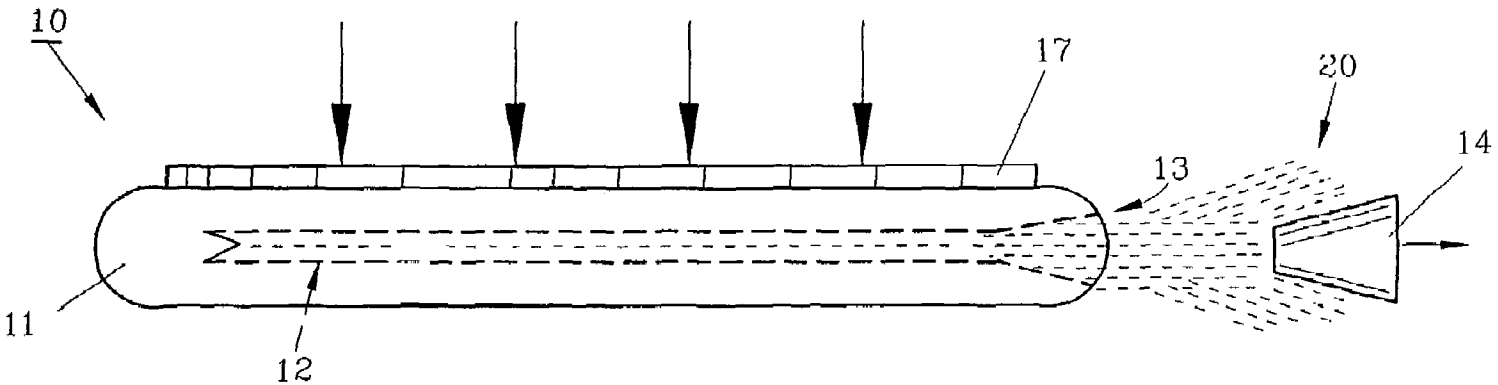
FIG. 3 schematically illustrates the attachment as seen in FIG. 2 at a slightly later time during impact with the attachment in a compressed state during fluid dissipation.

As schematically illustrated in FIG. 2, as attachment 10 initially strikes the ground or other surface to strongly impact the same, blowout plug 14 exits port 13 and fluid such as water 20 therein is beginning release to cushion or absorb the impact. FIG. 3 demonstrates footwear cushioning attachment 10 in schematic form at a slightly later time after full impact, with reservoir 11 and cavity 12 collapsed and with water 20 dispelled therefrom. Water 20 is the preferred fluid for use, though other fluids, liquids and the like may be used for specific conditions and environments.

Figure 5:
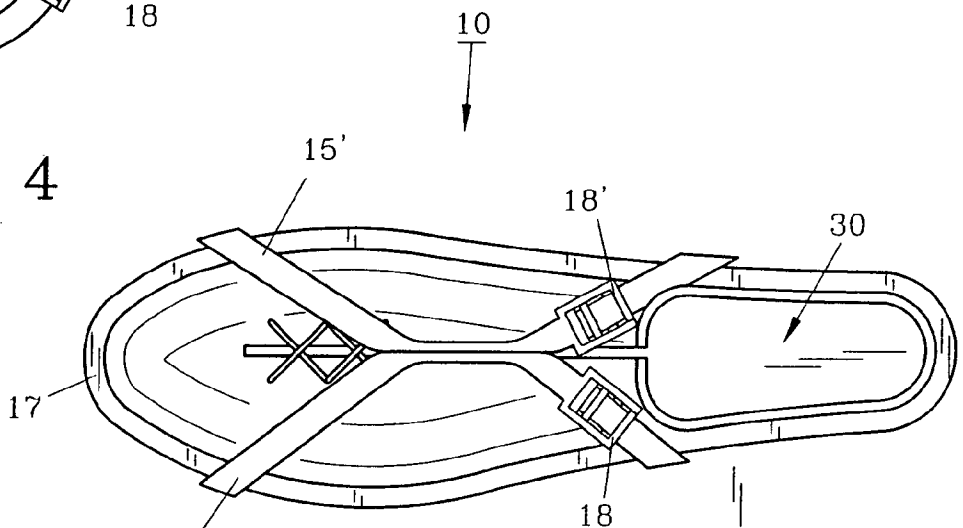
FIG. 5 pictures a top view of the footwear and attachment as shown in FIG. 1 along line 5—5.

Lip 17 surrounds the top of attachment 10 to maintain boot 30 in a stable posture when positioned on attachment 10. Lip 17 is approximately 0.3–0.6 cm in height and cap be integrally formed with reservoir 11 during molding or other manufacturing technique. U-shaped adjustable straps 15, 15' are adjustable by conventional buckles 18, 18' as shown in FIG. 4. Straps 15, 15' may be formed from a thin, flexible polyvinyl chloride and directly molded to reservoir 11. As seen in FIGS. 4 and 5, straps 15, 15' are releasably affixed across the top of boot 30.

While only the right boot is shown in FIGS. 1–6, as would be understood an identical attachment in mirror image form would be provided for the parachutist's left boot or other footwear.

In use, a parachutist would affix right footwear cushioning attachment 10 and a left footwear cushioning attachment (not shown) to the bottom of hit boots as shown in FIG. 1 during flight. Attachment 10 is designed for normal walking so blowout plug 14 remains in place as shown in FIG. 1. Upon jumping from the plane and impacting the ground below, high pressure derived from striking the ground causes water 20 within cavity 12 to force blowout plug 14 from rear port 13 thereby allowing water 20 to quickly exit. Exiting of water 20 allows reservoir 11 to controllably collapse, thus softening the impact on the lower extremities, back and other body areas.

The footwear cushioning attachments described herein may be used for other activities, other than for parachuting as desired. Thus, changes are anticipated by those skilled in the art for specific conditions, functions and activity needs and the illustrations and examples provided herein are for explanatory purposes only and are not intended to limit the scope of the appended claims.

I claim:

1. Footwear and an attachment for cushioning the impact of the footwear when striking the ground, the combination comprising:

A) a parachutist's footwear, and

B) an attachment for the parachutist's footwear, said attachment comprising a reservoir, said reservoir defining a cavity and a port, a blowout plug, said blowout plug positioned in said port, a fluid, said fluid contained within said reservoir, a means to affix said reservoir to said parachutist's footwear, said reservoir releasably affixed to said parachutist's footwear to dissipate energy as said reservoir strikes the ground.

2. The combination of claim 1 wherein said parachutist's footwear comprises a sole, and said attachment is shaped to complement said sole of said parachutist's footwear.

3. The combination of claim 1 wherein said port is positioned at the rear of said reservoir.

4. The combination of claim 1 wherein said affixing means comprises an adjustable strap.

5. The combination of claim 4 wherein said adjustable strap comprises a hook and loop fastener.

6. The combination of claim 1 wherein said fluid comprises a liquid.

7. The combination of claim 6 wherein said liquid comprises water.

8. The combination of claim 1 wherein said blowout plug is conically shaped.

9. The combination of claim 1 wherein said reservoir is formed from a polyvinyl chloride.

10. An attachment for cushioning the impact of footwear while striking a rigid surface, the attachment comprising: a flexible reservoir, said reservoir defining a cavity and a port, said cavity in fluid communication with said port, a blowout plug, said blowout plug positioned in said port, a means to affix said reservoir to the footwear, a lip, said lip surrounding the top of said reservoir to maintain the footwear thereon, said affixing means joined to said reservoir, and a liquid, said liquid contained within said cavity whereby upon impact said liquid will exit said cavity by urging said blowout plug from said port to dissipate energy therefrom.

11. The attachment of claim 10 wherein said port is defined at the rear of said reservoir.

12. A method of cushioning impact to a foot comprising the steps of:

1) donning footwear;
2) attaching an impact absorbing device to the footwear, the impact absorbing device comprising a reservoir, a fluid within said reservoir and a blowout plug;
3) impacting the absorbing device; and
4) allowing the fluid to escape the absorbing device to cushion the impact.

13. The method of claim 12 wherein the step of donning footwear comprises the step of donning a boot.

14. The method of claim 12 wherein attaching an impact absorbing device comprises the step of attaching an impact absorbing device with an adjustable strap to the footwear.

15. The method of claim 12 wherein impacting the absorbing device comprises the step of jumping from a plane.

* * * * *